US006546110B1

(12) United States Patent
Vonlanthen

(10) Patent No.: US 6,546,110 B1
(45) Date of Patent: Apr. 8, 2003

(54) BEHIND-THE-EAR HEARING AID AND ATTACHMENT MODULE FOR SAME

(75) Inventor: Andi Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/455,134

(22) Filed: Dec. 6, 1999

Related U.S. Application Data

(63) Continuation-in-part of application No. 09/340,951, filed on Jun. 28, 1999.

(30) Foreign Application Priority Data

Jun. 16, 1999 (WO) ..... PCT/CH99/00259
Nov. 15, 1999 (WO) ..... PCT/CH99/00537

(51) Int. Cl.[7] ..... H04R 25/00
(52) U.S. Cl. ..... 381/330; 381/314; 381/323
(58) Field of Search ..... 381/322, 323, 381/324, 330, 381, 314, FOR 127, FOR 129, FOR 131, FOR 134

(56) References Cited

U.S. PATENT DOCUMENTS 3,101,155 A 8/1963 Lehr et al.

FOREIGN PATENT DOCUMENTS

| | | | | |
|---|---|---|---|---|
| CH | 668154 | * 11/1988 | ..... | 381/FOR 134 |
| DE | 36 24 568 A1 | 1/1988 | | |
| DE | 37 23 809 A1 | 1/1989 | | |
| DE | 3723809 | * 1/1989 | ..... | 381/FOR 134 |
| DE | 297 18 104 U1 | 2/1998 | | |
| EP | 0 263 294 A2 | 4/1988 | | |
| EP | 0 337 195 A2 | 10/1989 | | |
| EP | 0 500 988 A1 | 9/1992 | | |
| GB | 2 305 067 A | 3/1997 | | |

* cited by examiner

*Primary Examiner*—Huyen Le
(74) *Attorney, Agent, or Firm*—Pearne & Gordon LLP

(57) ABSTRACT

A behind-the-ear hearing aid has a curved, hook-shaped shell that extends along a curved longitudinal axis of the hearing aid and into which are integrated transducers and electronics. A first end of the shell includes an acoustic output device to the ear. The shell defines a compartment located at a second end of the shell. The compartment is adapted to receive a battery, and has a cylinder axis that is substantially coaxial with the longitudinal axis of the hearing aid. The hearing aid includes an attachment module that includes a first portion having an outer cross-sectional contour corresponding to the outer cross-sectional contour of the hearing aid and a second portion having a reduced length of the outer cross-sectional contour, and the module is fitted with a rechargeable battery. The rechargeable battery is provided in the first portion and a voltage regulator is provided in the second portion.

7 Claims, 6 Drawing Sheets

BEHIND-THE-EAR HEARING AID AND ATTACHMENT MODULE FOR SAME

CROSS REFERENCE TO RELATED APPLICATION

The present application is a continuation-in-part of U.S. patent application Ser. No. 09/340,951, filed Jun. 28, 1999.

BACKGROUND OF THE INVENTION

Behind-the-ear hearing aids are known which comprise a curved, hook-shaped shell running substantially along an identically shaped hearing-aid axis and containing acoustic-electric transducers, electric-acoustic transducers and electronics. One shell end, usually the tapering end, constitutes the acoustic output device to the ear.

Such behind-the-ear hearing aids include a compartment to hold an ordinary or rechargeable battery. Such hearing aids use a button cell that is an ordinary or rechargeable battery. An axis of the battery is transverse to the above-mentioned axis of the hearing-aid shell. The design includes a hinging lid for the hearing-aid shell and retaining means for the cylindrical battery case that are arranged such that the latter's cylinder axis runs parallel to the pivot axis of the hinging lid. This configuration has several drawbacks.

Because the cylindrical case of the battery is transverse to the longitudinal axis of the curved, hook-shaped hearing-aid shell, the battery case wastes a relatively substantial space within the hearing aid. Moreover, there are mold parting lines between the hinging lid and the hearing-aid shell that run essentially along generatrices of the curved, hook-shaped hearing-aid shell. At least some of these parting lines will rest directly against the user's skin when in operation. Therefore, the parting lines constitute a comparatively elongated, critical site through which perspiration, humidity etc. may enter the battery compartment.

SUMMARY OF THE INVENTION

The present invention is directed toward eliminating or reducing the aforementioned drawbacks. According to the present invention, the battery compartment is situated at the shell end opposite the acoustic output device. The battery compartment is configured to receive a cylindrical rechargeable or ordinary battery case such that the cylinder axis of the battery compartment runs substantially coaxially with the hearing-aid longitudinal axis. Accordingly, an optimally minimal receiving volume or space is needed for the ordinary or rechargeable battery on account of the substantially cylindrical cross-section, in particular the inside cross-section of the hearing-aid shell, because the battery case now can be inserted coaxially with the hearing-aid tubular axis and in practice flush with the shell wall.

In a preferred embodiment of the invention, the above cited compartment comprises a first, preferably resilient, preferably central electric terminal, preferably also coaxial with the hearing aid's longitudinal axis, and at least one second electric terminal in the region of the erect compartment wall.

Even though merely two electric terminals suffice to contact a battery placed in the compartment, it may be advantageous in some circumstances to use more than two terminals in the compartment as regards another preferred embodiment of the hearing aid of the invention. The battery compartment of the hearing-aid shell, instead of holding an ordinary battery or a rechargeable battery, may receive the plug-in element of an attachment module, or an add-on module, to make electrical contact with at least two or more electric terminals. As regards the attachment module, which in this design includes the actual battery compartment at the hearing aid shell, it comprises a compartment at least substantially identical with the above mentioned compartment in the hearing-aid shell. In this manner, the module can be plugged into the battery compartment of the hearing-aid shell and the electric power then is supplied to the hearing aid by a cylindrical ordinary or rechargeable battery placed in the attachment-module compartment.

In this design, of course, more than one attachment module may be connected to the actual hearing-aid shell so as to practically extend the hook-shaped hearing-aid shell.

Whether the compartment is situated in the hearing-aid shell or, as mentioned above, is in an attachment module, it is furthermore fitted with a lid. The lid, in its closed position, is substantially perpendicular to the longitudinal axis of the hearing aid and preferably can be locked only by using a tool. This feature assures safety. For instance, when the hearing aid is used by children: lacking a tool, for instance a screwdriver, it will be impossible to remove the ordinary or rechargeable battery from the hearing aid.

The cited lid is of modular design and preferably can be removed in non-destructive manner from the hearing-aid shell. For example, after the lid has been removed, the lid can be reused on the hearing-aid compartment or used on the compartment of an attachment module.

Furthermore a code, for instance a color code, may be mounted on behind-the-ear hearing aids, to identify which ear, left or right, is to be fitted with the particular hearing aid.

In order to avoid fixed coding during the manufacture of comparatively complex parts, the invention proposes furthermore that the above mentioned lid be fitted with a left/right ear code, preferably located on an externally visible part of a lock mounted on the lid. In this manner all lids can be manufactured identically and externally coded parts, for instance coded in red or blue, will only be inserted during the assembly of a simple lock.

In an especially preferred embodiment of the hearing aid of the invention, an add-on module or a further add-on module with a plug-in element is inserted in the aforementioned compartment, in the hearing-aid shell or in that of an add-on module. The add-on module preferably encloses a rechargeable battery.

In a highly preferred embodiment, the rechargeable battery is a lithium battery in which the energy density is advantageously higher than that of other rechargeable batteries especially as regards the hearing-aid application. The preferably encapsulated unit of rechargeable battery and add-on module also preferably is fitted with a charging regulator. The charging regulator precedes the rechargeable battery on the input side and preferably includes an inductive charging input. The charging power is applied as desired through a transformer and without externally accessible and damage-susceptible rechargeable-battery terminals. In particular when a Li-ion rechargeable battery is used in such preferred manner, its effective voltage will be matched to requirements of the electronics following the hearing aid by a voltage regulator on the output side of the add-on module.

Basically it is highly advantageous to use a Li-ion rechargeable battery as the electric power source for a hearing aid, whether of the behind-the-ear or the in-ear type, and to exploit the properties of this kind of battery which are most advantageous with respect to hearing aids.

In accordance with further aspects of the invention, a number of substantial advantages regarding compactness, ease of maintenance and long life are offered compared to using other kinds of batteries.

The present invention provides a behind-the-ear hearing aid of modular design and having a hook-shaped shell fitted at one of its ends with a receiving compartment fitted with at least two accessible electrical terminals. A module's plug-in element is insertable into the receiving compartment, and the module, in turn, has its own compartment substantially identical with the aforementioned one in the hearing-aid shell. Leaving aside the question of how and where an ordinary battery, or a rechargeable one, is stored in the behind-the-ear hearing aid, it is intrinsically highly advantageous to situate the cited receiving compartment in the hearing aid to selectively allow correspondingly designed attachment modules to be mounted on the same basic hearing-aid configuration.

An attachment module of the invention for a hearing aid of the above kind comprises a plug-in element preferably subtending a substantially cylindrical external surface, a receiving compartment situated at the module and opposite the plug-in element to receive an element substantially shaped like the plug-in element and which can be locked by a preferably detachable, preferably tool-lockable lid. The attachment module preferably is in the form of modules for a wireless communication interface or a plug adapter module to adapt the hearing aid for further acoustic/electric transducers, a rechargeable-battery module which typically is larger than conventionally used ordinary batteries, a programming module or a mechanical drive module.

A further attachment module for the hearing aid consists of a first portion having a an external cross-sectional contour substantially corresponding to the external cross-sectional contour of the hearing aid, and a second portion of a comparatively lesser diameter, and a rechargeable battery. Preferably, this attachment module is encapsulated per se and, contrary to the module cited before, does not include its own compartment. Preferably, the rechargeable battery is integrated into the first, thicker portion, to be followed by a voltage regulator in the second, thinner plug portion. Moreover, a storage-battery charging regulator is preferably present in the first above cited portion and is preferably connected at the input side with an inductive pickup to be able to feed the charging power using a transformer, that is, being free of externally accessible terminals.

In a preferred embodiment and on account of the reasons given above, the rechargeable battery present in this attachment module preferably is a Li-ion battery.

BRIEF DESCRIPTION OF THE DRAWINGS

The behind-the-ear hearing aid of the invention and the attachment module of the invention are elucidated in an illustrative manner below in relation to the Figures showing a presently preferred embodiment of the behind-the-ear hearing aid.

DETAILED DESCRIPTION OF THE PREFERRED EMBODIMENTS

Figure 1:
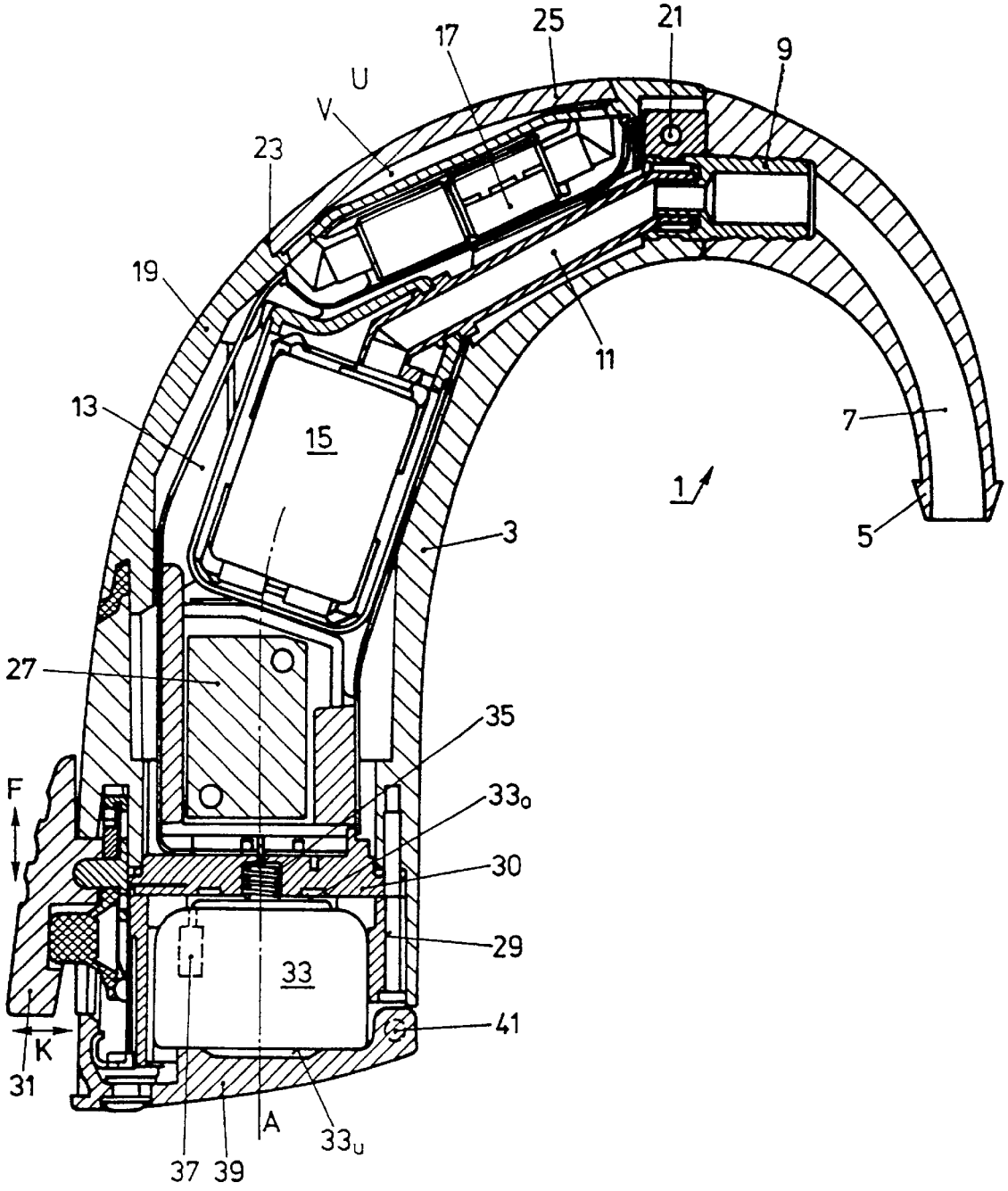
FIG. 1 is a simplified longitudinal section of a behind-the-ear hearing aid of the invention.

FIG. 1 is a partly simplified longitudinal section of the behind-the-ear hearing-aid assembly, of which the particular operational components or portions shall be discussed first. The hearing aid 1 comprises a curved, horn-shaped tubular shell having a central axis A. The shell is fitted at its thinner, curved end with an acoustic output device in the form of a connecting stub 5 to a coupling tube entering the ear. The connecting stub 5 is exchangeably slipped onto or screwed on a tube stub 9 seated in a shell segment 3.

The inner duct 7 of the connection stub 5 continues through the tube stub 9 into the transfer duct 11 in the shell segment 3. The transfer duct 11 is, in turn, coupled within a section 13 of the shell segment 3 to an electric/acoustic transducer system 15.

As shown by FIG. 1, the transfer duct 11 runs along the inner curvature of the shell segment 3 such that a space is subtended toward the outer curvature of the shell by a microphone unit 17. A lid 19 is integrated in this zone of the shell segment 3 and comes to a stop in the region of the apex of the hearing aid against a plug shaft 21. As shown in particular in FIG. 2, the lid 19 runs along generatrices M of the hearing-aid shell as far as (FIG. 1) the region of the electric/acoustic transducer system 15. The microphone unit 17 is accessible once the lid 19 has been removed and preferably makes electrical contact merely by means of a flexprint strap (not shown). The microphone unit 17 is tipped over the transfer duct 11, and rests against an acoustic input slot 23.

When the lid 19 is closed, at least two microphone orifices of the microphone unit 17 are opposite an inset 25 in a slot 23 of the lid 19. The inset 25 is acoustically transparent and comprises a plurality of apertures between the ambience U and a balancing volume V, the latter being left unencumbered between the discrete microphone orifices and the inset. Preferably, the inset 25 is made of a sintered material, in particular of sintered polyethylene, and moreover it is preferably coated in hydrophobic manner. The sintered material moreover subtends a "mesh" fineness between 10 and 200 $\mu$ and with an open-pore rate preferably above 70%. Furthermore, the microphone unit 17 and the inset 25 in the slot 23 are mounted to the hearing aid 1 so that, when the hearing aid is being used, they shall be, if possible, wholly shielded against dynamic ambient air pressure by being positioned in the zone of the apex of the horn-shaped tubular base unit (FIG. 1). In particular, as regards the embodiment of a directionally sensitive acoustic/electric transducer system using the aforementioned at least two mutually spaced microphones, the feature of the gap V entailing common mode suppression tends to cancel identical acoustic signals each at a different input along the inset 25 on account of the balancing effect of the volume V.

Furthermore the inset 25 acts as a soil shield and is easily cleaned on account of its preferred hydrophobic coating.

Another advantage of the inset 25 having a plurality of apertures, closely related to the above mentioned common mode suppression, is that any soiling should affect both microphones equally. The directional characteristics will remain unaffected, whereas soiling is a basic problem in conventional directional microphones having two or more discrete orifices.

Reference is made to the European patent document A 0,847,227 of this applicant regarding said inset 25 and its effects.

Figure 2:
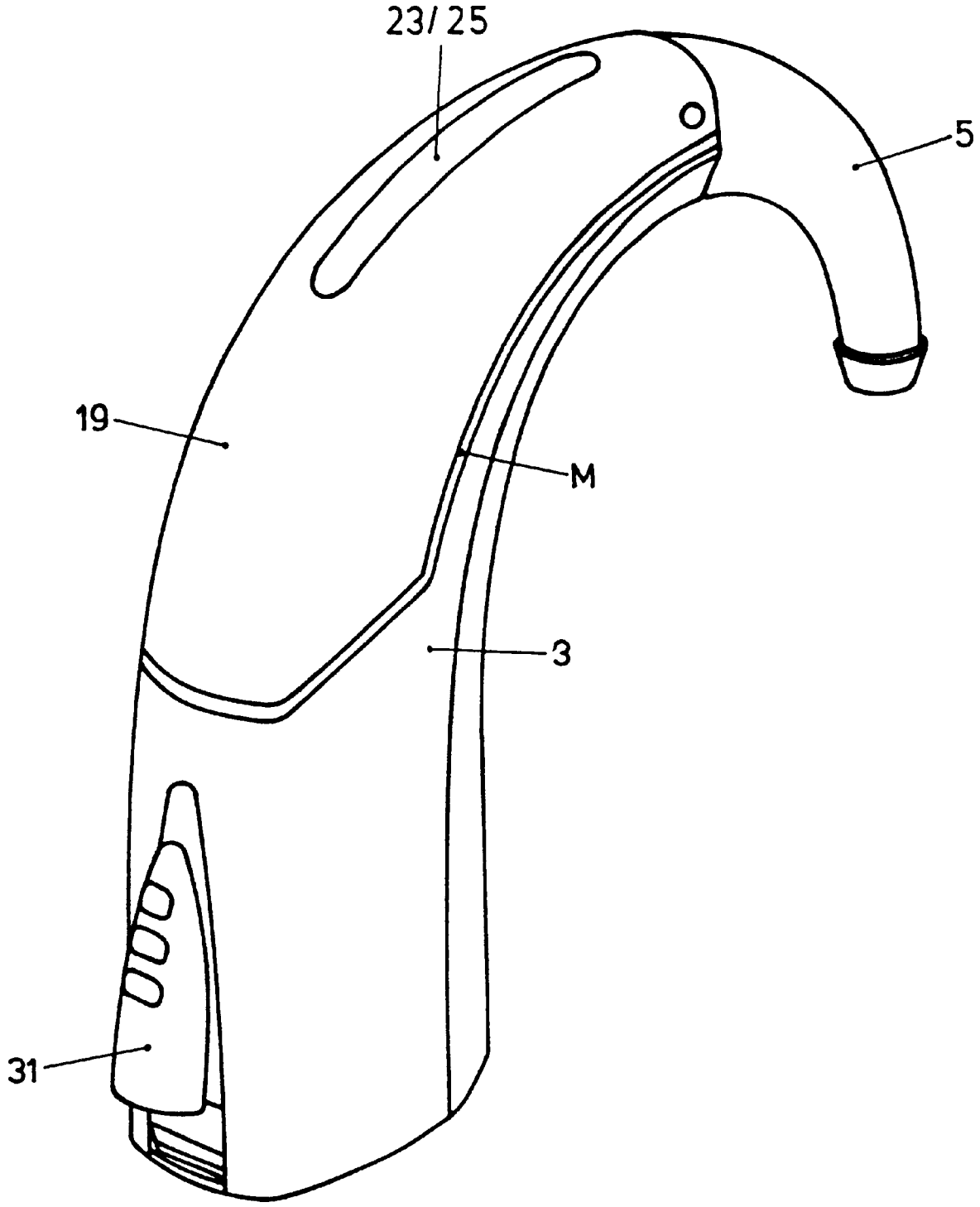
FIG. 2 is a perspective of the hearing aid of the invention.

An electronics 27 follows the electric/acoustical transducer system 15 in the shell segment 3 and in turn is followed by a battery compartment 29. A power switch 31 is present on the outside of the shell segment in the zone between the battery compartment 29 and the electronics 27. The perspective of FIG. 2 shows especially clearly the connecting stub 5, the shell segment 3, the lid 19 having an acoustic input slot 23 and an inset 25, further the power switch 31.

The Battery Compartment

The battery compartment 29 situated at end of the shell segment 3 receives a cylindrical, flat, ordinary battery or a correspondingly shaped rechargeable battery 33 such that the axis of the cylindrical battery, which has end surfaces 33*u* and 33*o*, is situated at least substantially coaxially with the longitudinal axis A of the hearing-aid shell.

A first resilient electrical terminal 35 is present at the bottom 30 of the battery compartment 29 centered on the axis A, and a second electric terminal 37 rests resiliently against the side surface of the battery 33. The battery compartment 29 can be closed by a lid 39 which, in its closed position, is transverse to the axis A and is supported in a pivotable or bayonet-lock manner on the shell segment 3 at 41 or on the battery compartment 29.

Substantial advantages are offered by this transverse configuration of the battery 33 in the hearing aid:

The surface sealed off by the lid 39 is comparatively large, so that it may be put to further uses as shall be elucidated below. Moreover, due to the battery-compartment lid 39 being situated at the greatest depth of the hearing aid and the lid's sites abutting the shell segment 3 being transverse to the axis A, penetration of perspiration into the battery compartment is hardly critical anymore. In this design of the battery compartment, the electric terminals 37 and 35 are protected inside the compartment, the lid 39 is free of electric terminals. Also, the substantially cylindrical inner space of the shell segment 3 is exploited fully and there is practically no dead space anymore.

Figure 3:
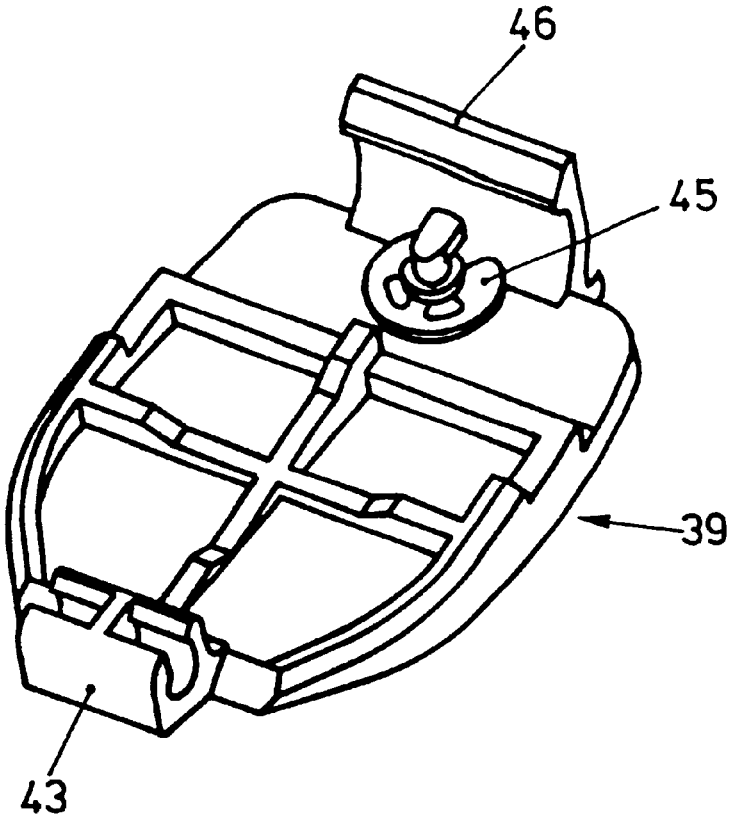
FIG. 3 is a perspective of the preferred embodiment of a battery-compartment lid at the hearing aid of the invention.

FIG. 3 is a perspective view of a preferred embodiment of the battery-compartment lid 39 designed as a hinged lid. This lid is easily detached from, or snapped into the pivot bearing 41 of FIG. 1 on account of the resilient hinge 43. In a preferred embodiment, the lid is further fitted with a lock 45 and a resilient pawl 46.

Figure 4:
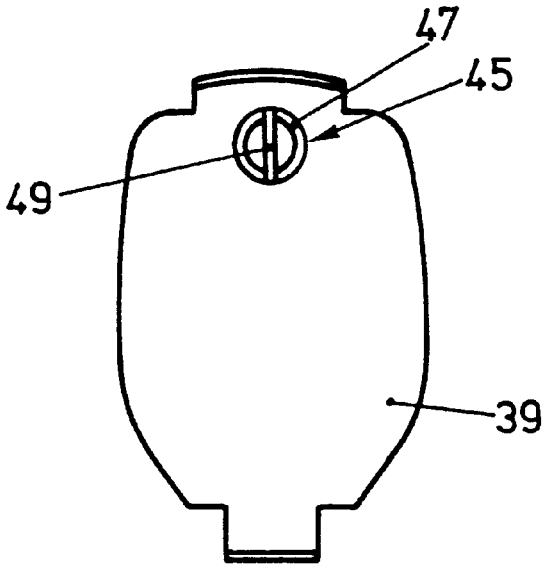
FIG. 4 is the top view of the lid of FIG. 3 with segments for left/right ear coding.

FIG. 4 shows an outside view of the lid 39 of FIG. 1. The lock 45 can be operated from the outside only using a tool, for instance a screwdriver, and for that purpose it is fitted with a drive means 49 in a rotating disk 47. The disk 47 is integrated into the hinge lid 39 only when the lock 45 is installed, and is dyed in specific manner. For instance, the disk may be dyed in two color codes, red and blue, thereby indicating whether the particular hearing aid is for the left or the right ear.

As already mentioned, the shown embodiment of the battery compartment 29, and in particular the feature of the flat cylinder constituting the battery being coaxial with the axis A of the hearing aid, does offer a substantial advantage: the hearing aid shown in FIG. 1 represents a basic configuration.

Figure 5:
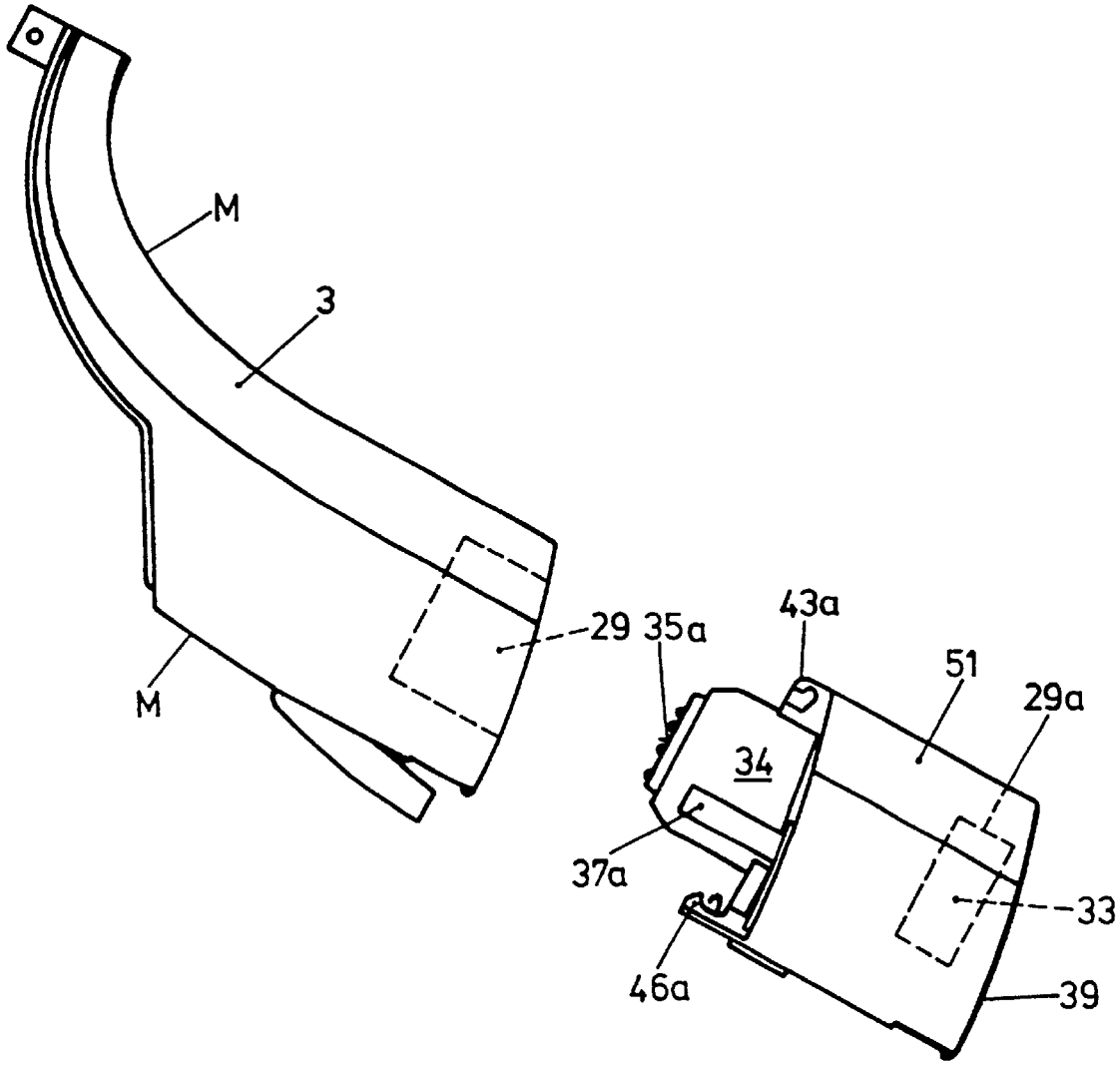
FIG. 5 is a perspective of, on one hand, the shell-segment of the hearing aid of the invention and on the other hand the add-on module of the invention.

It is frequently desirable to amplify this basic configuration with add-on options. Such add-on options may be an interface for wireless signal transmission, with a programming plug-in element, a further audio input, a larger rechargeable-battery compartment, a mechanical actuation system (e.g., manually operable control unit), etc. For that purpose the battery compartment shown in FIG. 1 is redesigned as shown by FIG. 5. The battery 33 is removed from the compartment and in its stead the plug-in element 34 of a corresponding add-on module 51 is plugged-in, and is made to electrically contact the corresponding terminals 35*a* and 37*a*.

Where such add-on modules are used, further electric terminals are easily provided in the compartment 29.

The compartment 29*a* acting as the actual battery compartment, together with the battery 33, now is present in the add-on module 51. The lid 39 is also removed from the shell segment 3 and snapped into position onto the add-on module or is affixed to it in the manner of a bayonet affixation.

Several such modules 51 may be stacked onto the base module of the hearing aid. Preferably, the particular affixation of the add-on modules 51 is implemented at a detent 43*a*, similarly to the hinge 43 at the hinged lid 39, and by a pawl 46*a* similar to the pawl 46 at said hinged lid 39, or, as regards bayonet locks, by appropriate insertion and locking by rotation.

In this manner the hearing aid can be built up modularly in the simplest possible manner and as desired. The ordinary battery or the rechargeable battery 33 always remains immediately accessible from the outside.

Electric/Acoustic Transducer System

Figure 6:
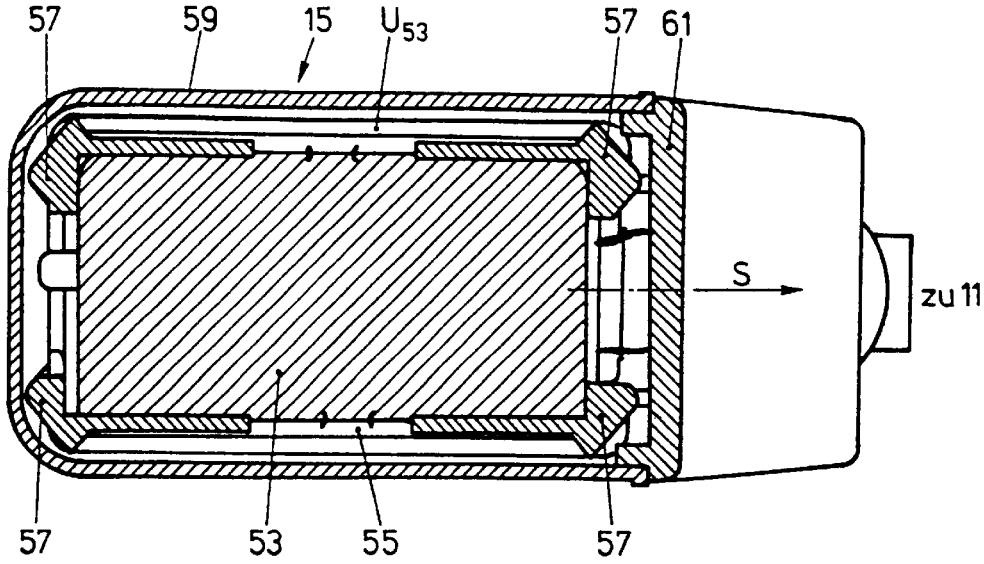
FIG. 6 is a view on an enlarged scale of the electric/acoustic transducer system unit of the hearing aid of the invention of FIG. 1.

The design and support of the above cited transducer system 15 in the shell segment 3 is shown in simplified manner in FIG. 6 and in elevation in FIG. 1. The transducer system 15 includes a loudspeaker (omitted), with a loudspeaker diaphragm, encapsulated inside a loudspeaker enclosure 53. The acoustic waves generated by the loudspeaker diaphragm are coupled from the space at the back side of the membrane in the loudspeaker enclosure 53 through apertures schematically indicated at 55 into the ambient space $U_{53}$ of the loudspeaker enclosure 53. As shown by the arrow S, the acoustic signals are coupled from the space at the front side of the membrane into the transmission duct 11 shown in FIG. 1.

The loudspeaker enclosure 53 is supported on all sides in substantially freely vibrating manner by elastic rubber bearings 57. The comparatively large space $U_{53}$ is defined by the supports 57 between the outer wall of the loudspeaker enclosure and a case 59, the space $U_{53}$ significantly enhancing the bass tones. The resonance chamber at the back side of the membrane is enlarged by a multiple by the space $U_{53}$. In order that the space $U_{53}$ can be acoustically effective over the full periphery, the case 59 and its support 61 are tightly connected.

As a result, the volume of the support of the loudspeaker system is utilized optimally acoustically. The case 59 furthermore acts in preferred manner as a magnetically shielding case and for that purpose preferably shall be made of $\mu$-metal. The case is beaker-like and is hooked in sealing manner in the form of a plastic support into the support 61. The above mentioned resilient and preferably elastic rubber bearings 57 are tensioned between the case 59, the support 61 and the loudspeaker enclosure 53.

Figure 8:
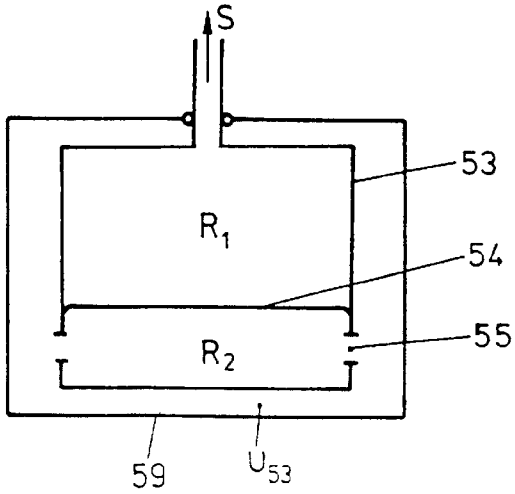

The above discussed acoustic coupling is shown in strictly functional manner in FIG. 8. The membrane 54 of the loudspeaker in the enclosure 53 defines in this enclosure a first space R1, which is coupled to the acoustic output device of the hearing aid denoted by S and a second space R2, which is coupled by one or more apertures 55 with the space $U_{53}$ subtended between the case 59 and the enclosure 53.

Power Switch 31

Figure 7:
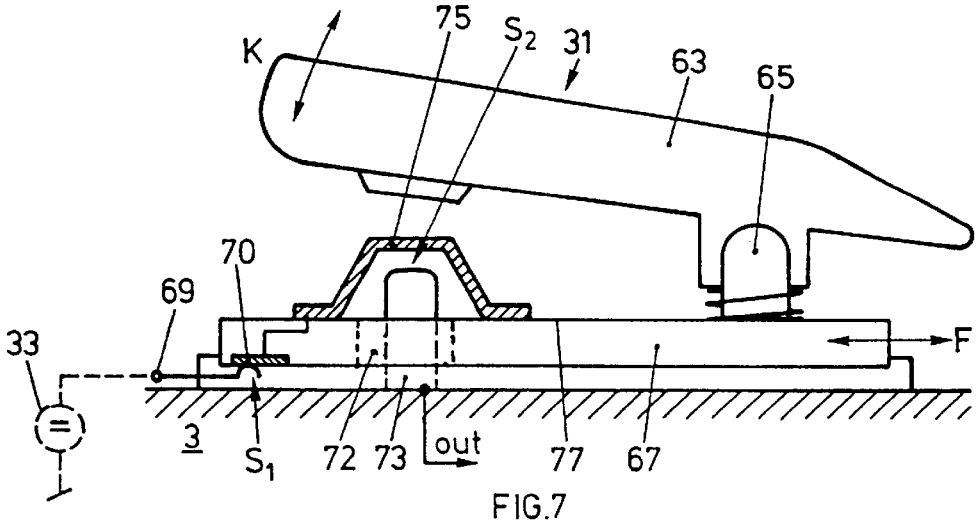
FIG. 7 is a simplified and schematic view of a drive means of the hearing aid of the invention, FIG. 8 schematically shows the unit of FIG. 6 to elucidate the acoustic couplings.

FIG. 7 shows a preferred embodiment of the power switch 31 in simplified and diagrammatic manner. The power switch 31 includes a toggle key 63 unilaterally resting at point 65.

The toggle support 65 is integrated into a slide 67 resting in linearly displaceable manner, as indicated by the double arrow F, relative to the shell segment 3. As diagrammatically shown by the spring-loaded terminal 69, which is stationary relative to the shell segment 3 and the shunt terminal 70 at the slide 67, the hearing aid is turned ON and OFF by means of the key 63 when moving the slide.

A borehole 72 is present in the slide 67 and is crossed by an electric pin terminal 73 affixed to the shell segment 3. This pin terminal 73 is spanned by a resilient electric terminal element 75 mounted on the slide 67 and preferably made of an elastic-rubber, at least partly electrically conducting plastic, to constitute a key, in the manner known for instance from remote-control keyboards. When toggling the key 63 in the manner shown by the double arrow K, the terminal element 75 makes contact with the pin terminal 73 and thus establishes electrical connection between them. Even though a number of possible electrical connections suggest themselves to the expert, including the switching path S1 as implemented by the slide motion F and the switching path S2 implemented by toggling the key 63, preferably, however, the spring-loaded terminal 69 shall be connected to the hearing-aid battery 38, and the jumper terminal 17 to the terminal element 75, as shown in dashed lines in FIG. 7. Accordingly, the pin terminal 73 acts as the electrical output device of the power switch.

In operation, the power switch 31 acts both as an ON/OFF slide switch and additionally, when in the ON position, as a toggle switch. As a result of this arrangement, the electronics 27 of FIG. 1 is controlled stepwise, for instance to implement rapid setting of amplification by the individual.

Accordingly the power switch 31 combines the two functions of slide switch and toggle switch, and this combination of functions is exceedingly advantageous, particularly for the behind-the-ear hearing aid. The operational differential precludes confusing the functions, such a confusion being substantially more critical when using two switches for the two cited functions.

Design of Shell Segment 3

As shown in particular by FIG. 5, the shell segment 3 consists of a curved and correspondingly shaped tubular part. In a preferred embodiment the shell segment 3 is integral and preferably made of plastic. However, unlike the conventional design of such hearing aids, the shell segment cannot be separated into two half-shells along generatrices M shown in FIG. 5. As a result, the assembly of the components into the shell segment 3 also is predetermined: they are merely inserted into the tube, which is a simpler assembly than for opened half-shells. Furthermore, an integral, tubular design offers the advantage of much increased mechanical strength relative to a split shell. In turn, the thickness of the shell-segment wall can be reduced and hence the shell also may be made more compact. Alternatively, if the external volume is kept constant, an increase of the available inside space will be achieved.

Rechargeable-battery Module

Figure 9:
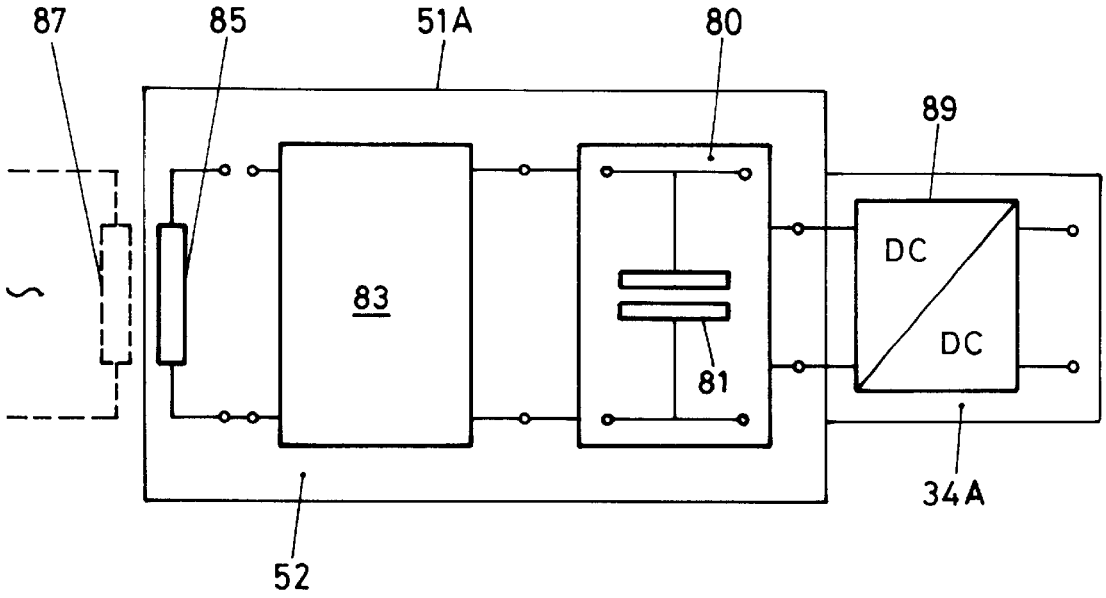
FIG. 9 shows another preferred embodiment of an add-on module in the form of a signal-flow block diagram.

FIG. 9 shows a special add-on module 51*a* which, like the module 51 described in relation to FIG. 5, is inserted into the battery compartment 29 or, if an add-on module 51 is already inserted therein, is placed into the compartment 29*a* of the already inserted add-on module 51.

The geometry of the add-on module 51*a* is shown in merely schematic manner in FIG. 9. The add-on module 51*a* is a rechargeable-battery module and, contrary to the case of the module 51 of FIG. 5, lacks its own receiving compartment 29*a* but preferably is enclosed per se in encapsulated manner. Its main portion 52, like that of the add-on module 51, cross-sectionally matches the cross-sectional contour of the shell segment 3, and, like the add-on module 51, comprises an integrated plug-in element 34*a* and further the design steps described in relation to the module 51. Preferably, a rechargeable-battery unit 80 is integrated into the main portion 52, preferably comprising a Li-ion rechargeable battery 81 and a charging regulator 83 servicing the rechargeable battery 81 and preceding the rechargeable-battery unit 80. The charging regulator is operationally connected at the input side to an inductive pickup 85 which, during charging of the rechargeable battery 81, forms the secondary of a transformer power transmitter together with the primary side 87 of a charger shown in dashed lines.

An output voltage regulator 89, a DC/DC converter, is preferably mounted in the plug element 34*a* at the output side of the rechargeable-battery unit 80. The regulator 89 transforms and stabilizes the output voltage of the rechargeable battery 81 to, and at, the voltage values required by the electronics of the hearing aid. The output voltage from the regulator 89 is applied to the electric terminals at the module 51*a* analogously to those of the module 51 of FIG. 5.

Advantages of the Overall Configuration

It is clear from FIG. 1 that the individual components (especially 11, 15, 27, 29 and/or 51, 51*a*) can be assembled by being inserted axially and consecutively into the shell segment 3. The shape of the shell segment 3 including corresponding guide means assures rapid and accurate positioning, the mutual electrical contacts of the electrically powered components being solder-free and implemented by spring-loaded electric terminals. As a result the components to be used may be pre-tested and sized without fear of degradation and then be assembled. Assembly is easily automated. The full shell, with shell segment 3 and lid 19 or 39, being fitted with appropriate seals at contact zones, is easily sealed.

The preferred embodiment of the electric/acoustic transducer 15 assures optimal magnetic shielding of the loudspeakers and optimal acoustic shielding against body acoustics.

Powering the hearing aid of the invention from a rechargeable-battery module, in particular from a Li-ion rechargeable battery, represents a most ecological technology which is also advantageous with respect to maintenance, and such features are enhanced by the possibility of inductive recharging in the absence of externally exposed electric terminals.

What is claimed is:

1. A behind-the-ear hearing aid comprising a curved, hook-shaped hearing-aid shell (5, 3, 19) that extends along an identically curved longitudinal axis (A) of the hearing aid and into which are integrated acoustic/electric transducers (17), electric/acoustic transducers (15) and electronics (27), a first end of the hook-shaped shell comprising an acoustic output device (5) to the ear, said shell defining a compartment (29), wherein the compartment is located at a second end of the shell that is opposite the acoustic output device (5), said compartment being adapted to receive a battery (33), and having a cylinder axis that is substantially coaxial with the longitudinal axis (A) of the hearing aid, wherein the hearing aid including an attachment module comprising a first portion having an outer cross-sectional contour corresponding to the outer cross-sectional contour of the hearing aid and a second portion having a reduced length of the outer cross-sectional contour, and the module being fitted with a rechargeable battery, and wherein the rechargeable battery is provided in the first portion and a voltage regulator is provided in the second-portion.

2. The attachment module as claimed in claim 1, wherein a charging regulator for the rechargeable battery is provided in the first portion and is connected to an inductive pickup.

3. The attachment module as claimed in claim 2, wherein the rechargeable battery is a rechargeable Li-ion battery.

4. The behind-the-ear hearing aid of claim 1, wherein said second portion of said attachment module is introduced into said compartment.

5. The behind-the-ear hearing aid of claim 4, wherein said second portion is releasably introduced into said compartment.

6. The behind-the-ear hearing aid of claim 1, comprising a further attachment module comprising a first portion having an outer cross-sectional contour corresponding to the outer cross-sectional contour of the hearing aid and a second portion having a reduced length of the outer cross-sectional contour, said second portion of said further attachment module being introduced into said compartment, said further attachment module comprising a further compartment in its first portion, said second portion of said attachment module residing in said further compartment of said further attachment module.

7. The behind-the-ear hearing aid according to claim 6, wherein said further attachment module is one of a wireless communication module, an acoustical to electric converter module, a manually operable control unit module, a programming unit module.

* * * * *